US006354721B1

(12) United States Patent
Zattoni

(10) Patent No.: US 6,354,721 B1
(45) Date of Patent: Mar. 12, 2002

(54) HEADLAMP FOR MOTOR VEHICLES

(75) Inventor: Sergio Zattoni, Cafasse (IT)

(73) Assignee: Automotive Lighting Italia S.p.A., Venaria Reale (IT)

( * ) Notice: Subject to any disclaimer, the term of this patent is extended or adjusted under 35 U.S.C. 154(b) by 0 days.

(21) Appl. No.: 09/499,306

(22) Filed: Feb. 7, 2000

(30) Foreign Application Priority Data

Feb. 8, 1999 (IT) ..... MI99A0239

(51) Int. Cl.[7] ..... F21V 17/02

(52) U.S. Cl. ..... 362/513; 362/509; 362/512; 362/539; 362/263; 362/347; 362/284; 362/286; 362/351

(58) Field of Search ..... 362/509, 512, 362/513, 539, 263, 271, 286, 351, 347

(56) References Cited

U.S. PATENT DOCUMENTS 5,673,990 A * 10/1997 Neumann et al. ..... 362/512
5,899,559 A * 5/1999 Lachmayer et al. ..... 362/513

FOREIGN PATENT DOCUMENTS

DE 3806658 9/1989
DE 4002576 8/1991
DE 19537838 4/1997
DE 19708111 9/1998

* cited by examiner

*Primary Examiner*—Sandra O'Shea
*Assistant Examiner*—Ali Alavi
(74) *Attorney, Agent, or Firm*—Shlesinger, Arkwright & Garvey LLP

(57) ABSTRACT

Headlamp for motor vehicles, which can generate selectively a full light beam and a dipped/fog light beam, including a reflector which is subdivided into an upper reflective area, and a lower reflective area, and has an optical axis, along which there is disposed a single fixed light source consisting of a bulb with a single filament, a lens, which is disposed in a front position and at right-angles relative to the optical axis, and can converge the dipped/fog light beam, intermediate screens which are partially mobile, and can assume selectively a first position, in which they can intercept part of the said full light beam, in order to convert the latter into the said dipped/fog light beam, and a second position, in which the said full beam is not intercepted, and movement means in order to displace the said intermediate screens between the said first and second positions, which means are disposed on the exterior of a casing, which contains the reflector, the light source, the lens and the intermediate screens.

7 Claims, 4 Drawing Sheets

8
11
16
10
9
6
22
21
9b
24

HEADLAMP FOR MOTOR VEHICLES

The present invention relates to a headlamp for motor vehicles, which can generate selectively a full light beam and a dipped/fog light beam.

BACKGROUND OF THE INVENTION

The headlamps which are fitted at present onto motor vehicles perform the full- and dipped-beam functions by means of a two-filament halogen lamp and substantially bifocal optics, or by means of two single-filament lamps, and separate optics. In the first case, the headlamp comprises a bifocal reflector, along the optical axis of which, and more specifically at the focal point of which, there are disposed the two filaments of the lamp, which can be actuated alternately; an intermediate screen which is disposed facing one of the two filaments, and can intercept part of the light emitted by this filament, in order to obtain as output from the headlamp a dipped light beam which is provided with the corresponding cut-off (i.e. with the corresponding light/dark demarcation line), whereas the light emitted by the second filament is used entirely for generation of the full light. In the second case, two separate reflectors are provided, each for a single filament lamp, and are designed in order to obtain respectively a full light beam and a dipped light beam.

Each of the two above-described solutions requires a compromise between simplicity, economic viability and size.

SUMMARY OF THE INVENTION

The object of the present invention is to provide a headlamp which can be fitted to motor vehicles, which is at the same time simple, economical, and has a reduced size.

On the basis of the invention, there is thus provided a headlamp for motor vehicles, which can generate-selectively a full light beam and a dipped/fog light beam, comprising a single light source, intermediate screens, which are at least partially mobile, and can intercept part of a light flow emitted by the light source, and movement means, which can displace the said mobile intermediate screens selectively, between at least two different positions: in the first of these positions, the intermediate screens can intercept part of the light flow, whereas in the second position, they do not intercept the flow.

In particular, the intermediate screens comprise a fixed intermediate screen, which can define a light/dark demarcation line of the dipped/fog beam, and a mobile intermediate screen; the said intermediate screens are held together by means of a hinge which can permit rotation of the mobile intermediate screen. When the intermediate screens are in the first operating position, in order to permit passage of a light beam obtained from the lower reflecting part, the mobile intermediate screen is disposed substantially parallel to the optical axis, and substantially at right angles to the fixed intermediate screen, and when the intermediate screens are in the second operating position, in order to intercept a light beam from the lower reflecting part, the mobile intermediate screen is disposed substantially at right angles to the optical axis, and substantially aligned with the fixed intermediate screen.

This therefore provides a headlamp which can perform the full beam and dipped/fog beam functions by means of a single lamp with a single filament, and bifocal optics. The solutions proposed are simple and economical, and provide the structure with a minimum size, and which can be adapted to different models of motor vehicles.

BRIEF DESCRIPTION OF THE DRAWINGS

Further characteristics and advantages of the present invention will become apparent from the following description of a non-limiting embodiment, provided with reference to the figures of the attached drawings, in which.

DETAILED DESCRIPTION OF THE INVENTION

Figure 1:
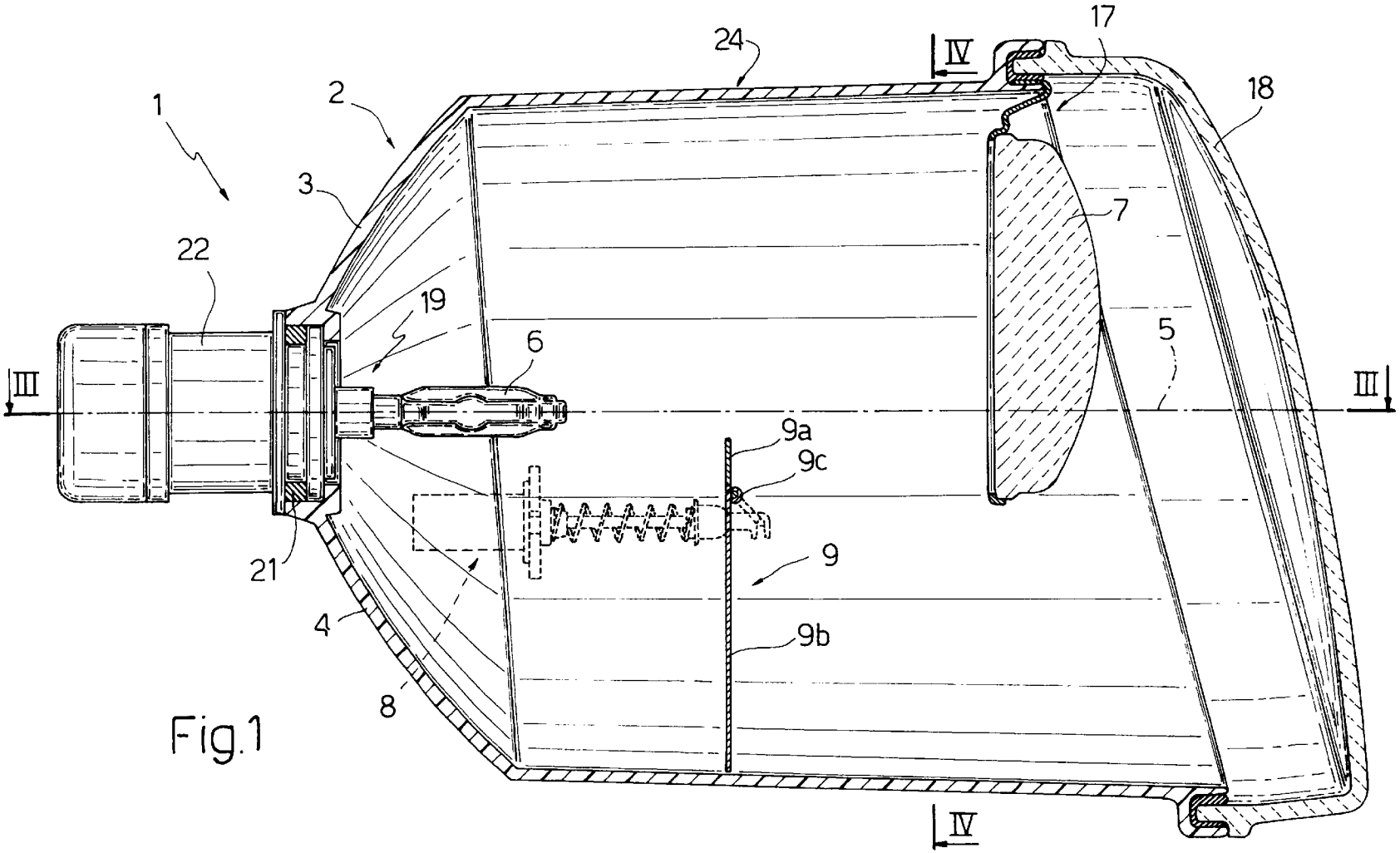
FIG. 1 is a view in longitudinal cross-section of the headlamp according to the present invention, in an operative condition in which the headlamp itself is functioning as a dipped/fog beam.
Figure 2:
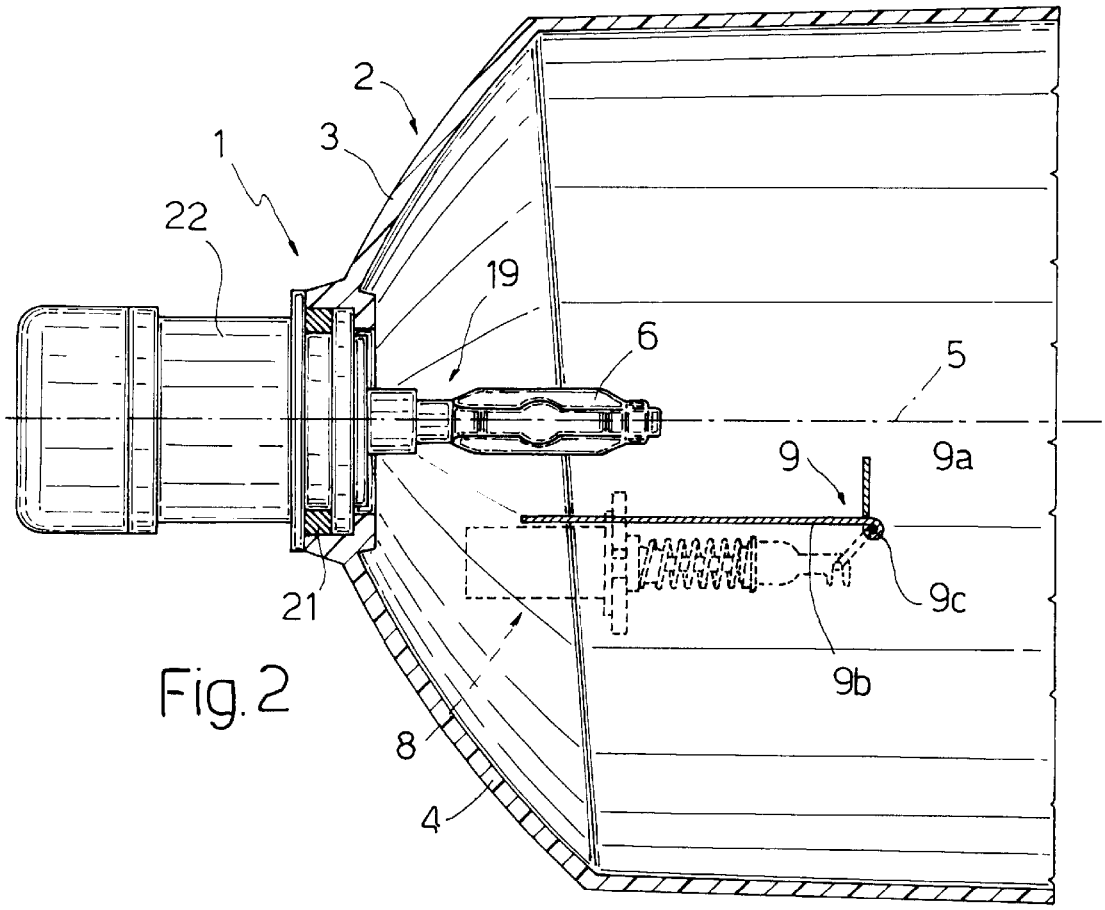
FIG. 2 illustrates the same view, with the headlamp in another operative condition in which it is functioning as a full beam.

With reference to FIGS. 1 and 2, 1 indicates as a whole a headlamp for motor vehicles, the substantial parts of which comprise: a reflector 2, which is subdivided into an upper reflecting area 3, and a lower reflecting area 4, and has an optical axis 5; a lamp/lamp-holder unit 19, which is disposed along the optical axis 5; a lens 7, which can converge a dipped/fog light beam; intermediate screens 9; and movement means 8, which are disposed on the exterior of a casing 24 which contains the reflector 2, the light source, the intermediate screens 9 and the lens 7. In particular, the movement means can move the intermediate screens 9 between a first operating position, in which the headlamp 1 can generate a full light beam (FIG. 2), and a second operating position, in which the headlamp 1 can generate a dipped/fog light beam (FIG. 1).

In this case, the casing 24 is integral with the reflector 2, and defines a front aperture 17, which is closed by a transparent component 18, which can guarantee watertightness of the reflector itself.

According to a preferred embodiment of the invention, the upper reflecting area 3 is of the mono-focal type, and the lower reflecting area 4 is of the complex type.

The lamp/lamp-holder unit 19 extends through a circular cavity 20 which is provided in the rear part of the reflector 2 and comprises: a lamp 6 with a single filament, which can be of the incandescent or gas discharge type, and is disposed at least partially inside the concavity defined by the reflector 2; a lamp-holder tube 21, which has a substantially annular shape, is disposed co-axially relative to the axis 5, and can be fitted in a manner which is known, and is not illustrated for the sake of simplicity, in the circular cavity 20; and a support body 22, which has a substantially cylindrical shape.

The lamp/lamp-holder unit 19 also comprises an electrical connection body (not shown) which is fitted to the rear of the support body 21.

The lens 7 which can converge the dipped/fog light beam is disposed in a front position at the front reflecting area 3, and at right angles relative to the optical axis 5.

The intermediate screens 9 are disposed at the lower reflecting area 4, and comprise a fixed intermediate screen 9*a*, which can define a light/dark demarcation line 25 (known as the cut-off), and has a shape pre-determined by the dipped/fog beam, and a mobile intermediate screen 9*b*. In a first operating position, in order to permit passage of the light beam obtained from the lower reflecting part 4, the mobile intermediate screen 9*b* is disposed substantially parallel relative to the said optical axis 5, and substantially at right angles to the fixed intermediate screen 9*a*; in a second operating position, in order to intercept the light beam obtained from the lower reflecting part 4, the mobile intermediate screen 9*b* is disposed substantially at right angles to the optical axis 5, and substantially aligned with the fixed intermediate screen 9*a*.

These intermediate screens 9*a* and 9*b* are held together by means of a hinge 9*c*, which can permit rotation of the mobile intermediate screen 9*b*.

In order to be able to be rotated, the mobile intermediate screen 9*b* is integral with a lever 10.

The movement means 8 comprise: an electromagnet 11, which supports a mobile core 12, which defines a rod, the free end of which has a sphere 13; an arm 14, which on its first end defines a spherical cavity 13*a*, which can retain the sphere 13, whereas its second end defines a seat 15 which can accommodate the lever 10; and a helical spring 16 which is wound around the mobile core 12, one end 16*a* of which is secured to the arm 14, at a seat 14*a*, and the other end 16*b* of which is secured to the electromagnet 11 at a seat 11*a*.

According to a preferred embodiment of the invention, the movement means 8 are secured to the exterior of the casing 24 which contains the reflector 2, the light source, the intermediate screens 9 and the lens 7, by means of a support frame 23.

The headlamp 1 functions as follows.

Figure 5:
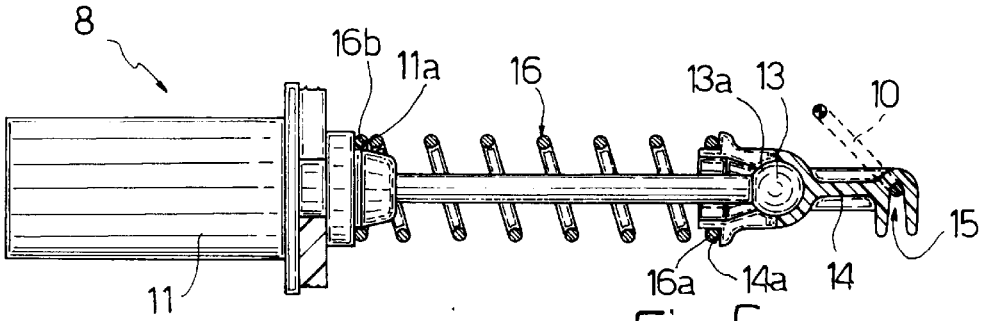
FIG. 5 is a view in longitudinal cross-section of the movement means according to the present invention, in an operative condition in which the headlamp is functioning as a dipped/fog beam.
Figure 6:
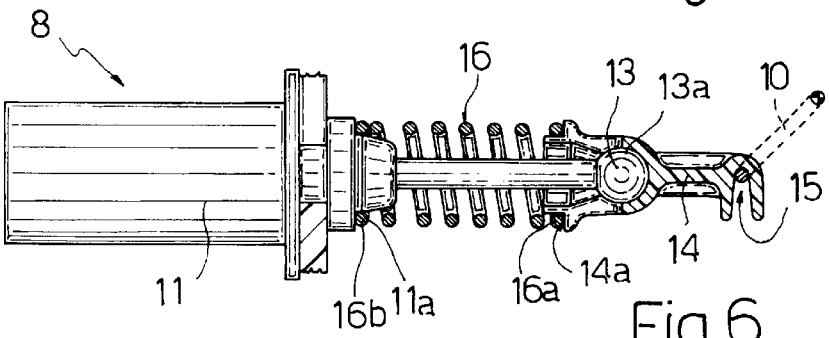
FIG. 6 illustrates the same view, with the movement means in an operative condition in which the headlamp is functioning as a full beam.
Figure 3:
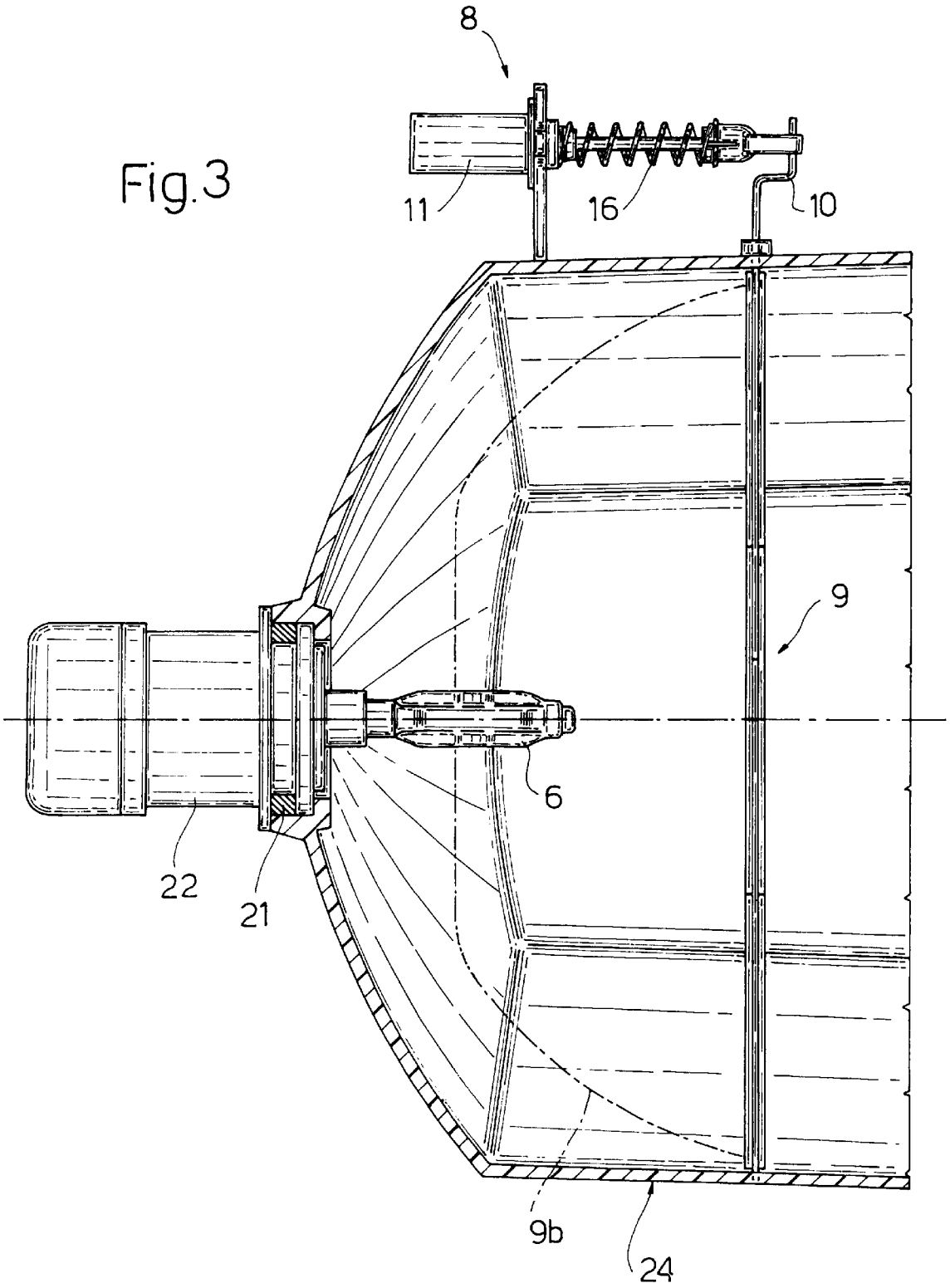
FIG. 3 is a view in transverse cross-section of the headlamp in FIG. 1, according to the line III—III in FIG. 1, in an operative condition in which the headlamp itself is functioning as a full beam.
Figure 4:
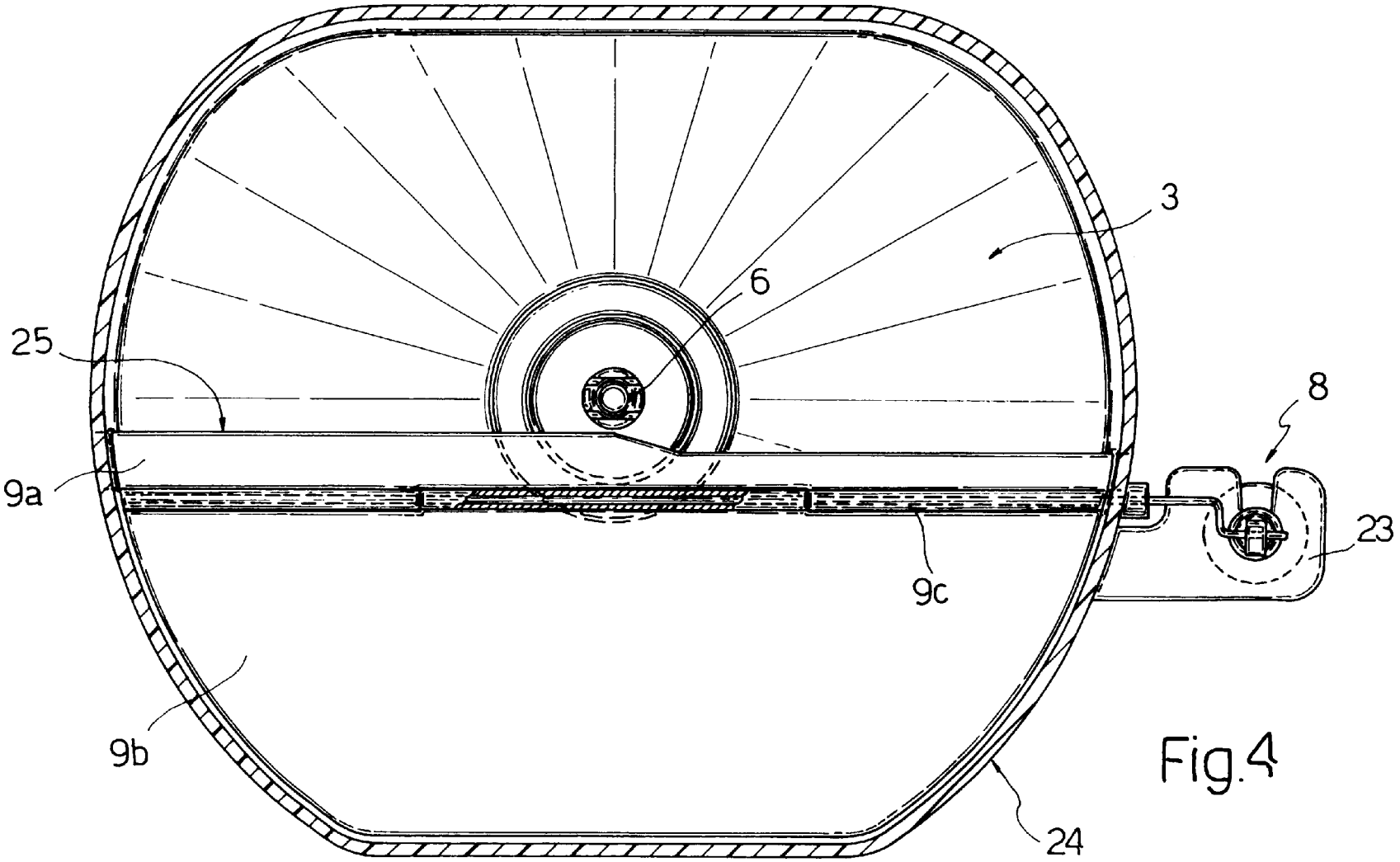
FIG. 4 is a view in transverse cross-section of the headlamp in FIG. 1, according to the line IV—IV in FIG. 1, in an operative condition in which the headlamp itself is functioning as a dipped beam.

It is assumed that initially, the movement means 8 are in the above-described dipped/fog condition (FIG. 1; FIG. 5) and that consequently, the intermediate screens 9 are in the said second operating position, such that the mobile intermediate screen 9*b* can intercept the flow of light reflected by the lower reflecting part 4, thus providing a dipped or fog beam, according to the profile of the light/dark demarcation line 25.

In order to change to operation as a full beam, the movement means 8 are actuated such as to change to the full-beam condition (FIG. 2; FIG. 5). The supply to the electromagnet 11 is switched on, and makes the mobile core 12 contract. The mobile core 12 transmits the motion to the arm 14, which then exerts thrust on the lever 10 (FIG. 5). After it has undergone this thrust, the lever 10 gives rise to rotation of the mobile intermediate screen 9*b*, making it assume at its end of travel a position which is substantially parallel to the optical axis 5, and substantially at right-angles to the fixed intermediate screen 9*a* (FIG. 2). In this case, all of the light flow emitted by the lamp 6 is reflected by the reflector 2; in particular, the portion of light flow reflected by the area 4 is not intercepted by the mobile intermediate screen 9*b*, such that a full beam is generated, which is not affected by the fixed intermediate screen 9*a*.

In order to return to operation as a dipped beam, the supply to the electromagnet 11 is interrupted, such that the arm 14 is subjected to the return force of the spring 16, and returns to the initial position (FIG. 5). Consequently, the arm 14 returns the lever 10 to the initial position (FIG. 5). By means of the movement of the lever, the mobile intermediate screen 9*b* is returned substantially at right-angles to the optical axis 5, and substantially aligned with the fixed intermediate screen 9*a*, in which position the headlamp generates a dipped/fog light beam (FIG. 1).

Finally, it is apparent that modifications and variants which do not depart from the context of the claims, can be made to the headlamp described.

For example, it is possible to keep the intermediate screen 9*b* fixed in the position in which it intercepts the beam reflected by the reflecting area 4, and on the other hand, to make the intermediate screen 9*a* mobile, such as to modify the profile of the light/dark demarcation line 25, thus obtaining selectively a dipped or a fog light beam.

What is claimed is:

1. Headlamp for motor vehicles, comprising:

a single light source including a single-filament lamp;

a reflector subdivided into an upper reflecting area and a lower reflecting area, said reflector including an optical axis along which is disposed said light source;

a lens disposed at right angle to said optical axis to converge the light beam into a dipped/fog light beam;

an intermediate screen positioned to intercept part of a light flow emitted by said light source;

said intermediate screen comprising a fixed screen defining a light/dark demarcation line of the dipped/fog light beam, and a mobile screen, said fixed and mobile screens being held together by a hinge to allow said mobile screen to rotate;

said intermediate screen comprising movement means to displace said mobile screen selectively between at least first and second positions, said first position for intercepting part of the light flow, and said second position for not intercepting the light flow;

said intermediate screen is disposed in said lower reflecting area;

a lever operably secured to said mobile screen to rotate said mobile screen;

said movement means comprising an electromagnet;

a mobile core supported by said electromagnet, said mobile core defining a rod having a free end to which is secured a sphere;

an arm having a first end defining a spherical cavity in which said sphere is disposed, and a second end defining a seat to accommodate said lever;

a helical spring wound around said mobile core, said helical spring having one end secured to said arm at a seat, and another end secured to said electromagnet at a seat;

whereby when power is supplied to said electro-magnet, said electro-magnet supports said lever in a position such that said mobile screen is in said first position, and said spring generates a return force to return said lever to a position such that said mobile screen is placed in said second position.

2. Headlamp according to claim 1, wherein:

said mobile screen when in said first position is disposed substantially parallel to said optical axis, and substantially at right angle to said fixed screen to permit passage of the light beam obtained from said lower reflecting area; and said mobile screen when in said second position is disposed substantially at right angle to said optical axis, and substantially aligned with said fixed screen to intercept the light beam obtained from said lower reflecting area.

3. Headlamp according to claim 1, wherein:

said movement means is secured to an exterior of a casing with a support frame, said casing containing said reflector, said light source, and said intermediate screen.

4. Headlamp according to claim 3, wherein:

said reflector is integral with said casing; and said reflector defines a front aperture closed by a transparent component.

5. Headlamp according to claim 1, wherein:

said single-filament lamp is an incandescent lamp.

6. Headlamp according to claim 1, wherein:

said single-filament lamp is a gas discharge lamp.

7. Headlamp as in claim 1, wherein:

said lever is integral with said mobile screen.

* * * * *